United States Patent [19]

Osann

[11] 4,067,574

[45] Jan. 10, 1978

[54] MANUAL DEXTERITY PERCUSSION GAME

[76] Inventor: Robert Osann, Fiddlers Green Drive, R.D. 3, Huntington, N.Y. 11743

[21] Appl. No.: 722,389

[22] Filed: Sept. 13, 1976

[51] Int. Cl.[2] ..... A63B 67/00

[52] U.S. Cl. ..... 273/95 R; 273/1 R; 273/67 R; 273/102.1 B

[58] Field of Search ..... 273/1 R, 95 R, 95 A, 273/102 R, 102.1 B, 102.1 F, 67 R, 84; 272/1 R

[56] References Cited

U.S. PATENT DOCUMENTS

| | | | |
|---|---|---|---|
| 157,363 | 12/1874 | Bedford | 273/102.1 B |
| 838,105 | 12/1906 | Grant | 273/102 R |
| 1,575,204 | 3/1926 | Hilty | 273/102.1 B |
| 1,589,312 | 6/1926 | Hill | 273/1 R X |
| 3,366,386 | 1/1968 | Lindholm et al. | 273/67 R X |

OTHER PUBLICATIONS

Chemical Abstracts, vol. 85, (1976), which reports, as item 85:86214*n*, Japanese Patent 76,42,988, Ogihara et al.

*Primary Examiner*—William H. Grieb

[57] ABSTRACT

A percussion game is provided comprising at least one target, each adapted to be manipulated by the hands of one contestant and to be hit by at least one striking implement, each manipulated by the hands of another contestant, said targets each comprising a base portion to which is affixed a handle for manipulating the target, a metallic body mounted above said base and adapted to emit an audible sound upon impact with a striking implement held by the other contestant, the outer dimensions of said base when viewed from above being at least equal to those of said metallic body mounted thereabove, such that such metallic body will emit a substantial audible sound upon contact with a striking implement from above the base portion when the target is in a normal upright position with respect to the base.

24 Claims, 14 Drawing Figures

FIG. 1
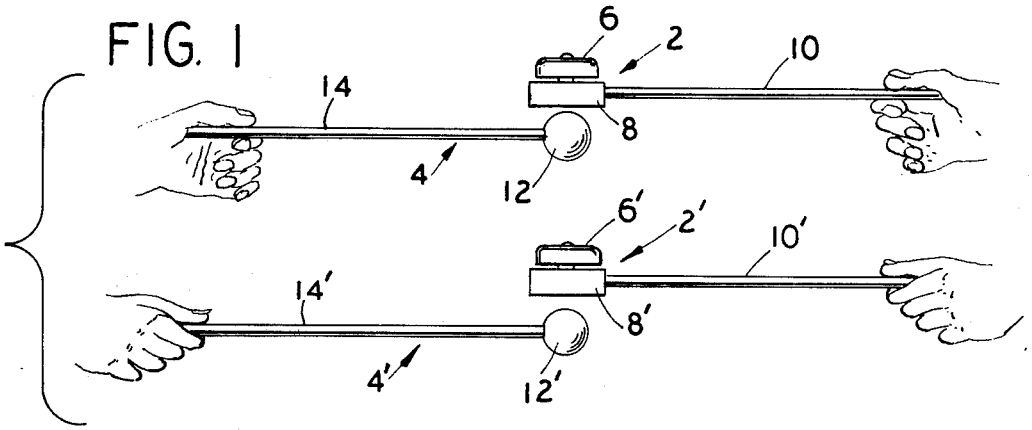
FIG. 2
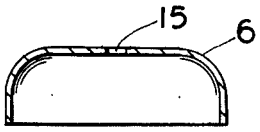
FIG. 5
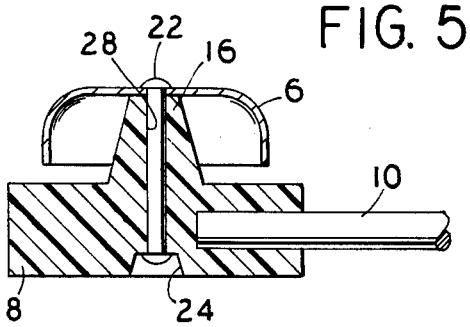
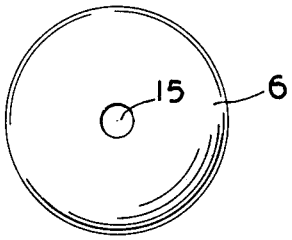
FIG. 3
FIG. 6
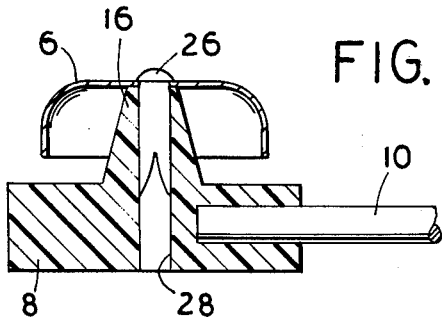
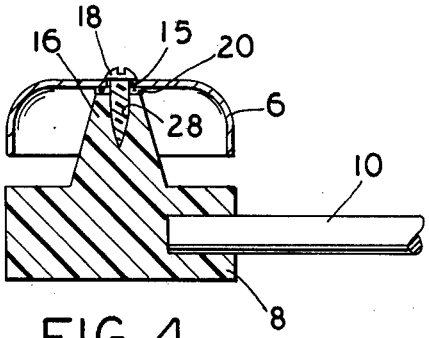
FIG. 4
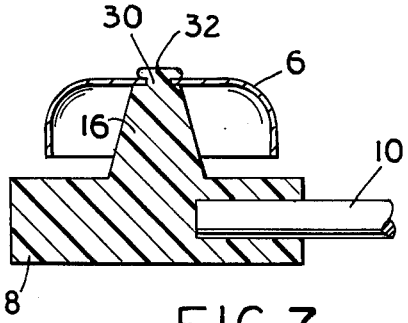
FIG. 7

FIG. 8
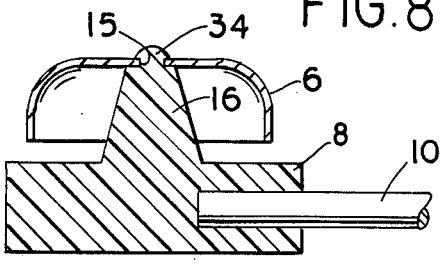
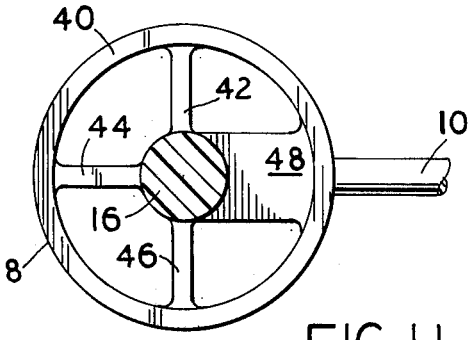
FIG. 11
FIG. 9
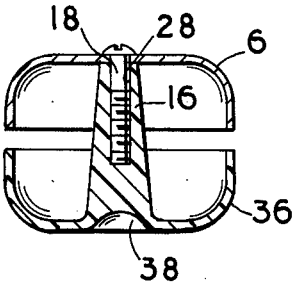
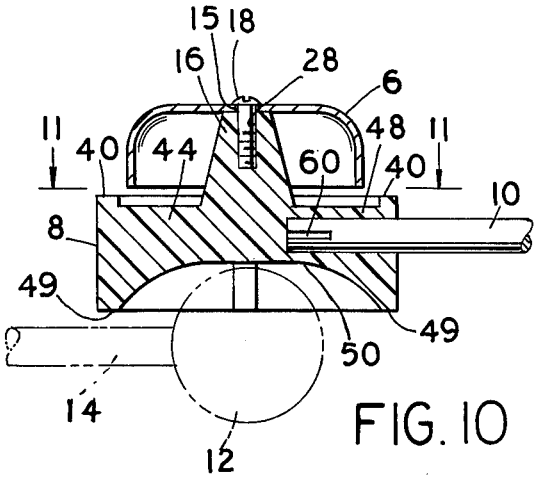
FIG. 10
FIG. 13
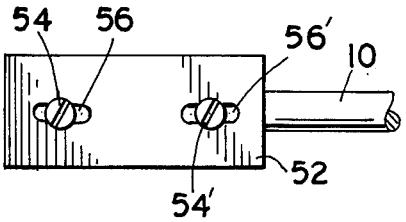
FIG. 14
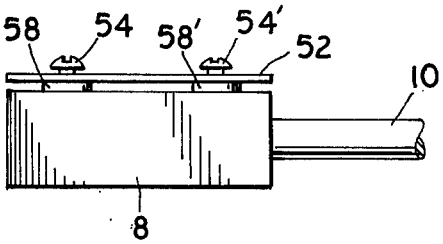
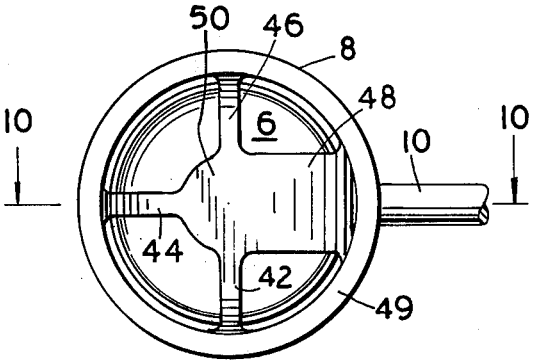
FIG. 12

MANUAL DEXTERITY PERCUSSION GAME

BACKGROUND OF THE INVENTION

This invention relates to a game of skill, and more particularly, to a game of manual dexterity wherein the reflexes of the contestants are put to the test.

There are many so-called games and/or toys of the prior art which involve the use of a striking implement such as a mallet and a target of one kind or another, but these, for the most part, can be characterized merely as amusement devices for children, having little or no relationship to the skill of the person participating in the so-called game. A "game" in the true sense of the word involves a contest, wherein each of the contestants has a corresponding equal chance of scoring or winning, depending upon this skill and proficiency in playing the game.

It is therefore a primary object of this invention to provide a new and unique game which presents a challenge to the manual dexterity of the contestants in a manner not heretofore available in the prior art.

SUMMARY OF THE INVENTION

In accordance with a preferred embodiment of the present invention there is provided a new game which comprises a pair of striking implements and a pair of corresponding targets, wherein the size, weight and balance of both striking implements with respect to each other and of both targets with respect to each other are substantially the same; and wherein the size, weight and balance of each target with respect to each striking implement are preferably substantially equal to or approach that of the other respectively, or wherein these variables are so adjusted with respect to each other that each contestant will be given a substantially equal opportunity to score or miss in the course of playing the game. This is accomplished by generally providing a pair of striking implements, each to be held in the left and right hands of one contestant; and a pair of targets, each to be held in the left and right hands of the other contestant.

The game is essentially played by having the contestant holding the striking implements attempt to hit the targets held by his opponent, or miss the same. This will result in a score or a miss, and depending upon the rules of the game, the positions of the players may then be reversed or a score or miss recorded as desired.

The target employed is preferably in the form of a bell, gong or similar percussion member, which will produce a distinctly audible sound upon impact with a striking implement, such as a mallet.

To equalize the opportunity to score, (by hitting the target) or to miss the target with a mallet, the mallet ideally should be of a weight such that its fulcrum from its center of gravity should preferably be about equal to or approach that of the fulcrum of the target, thereby establishing such balance between the striking implement with respect to the target to give each contestant a corresponding equal chance to score or miss, as the case may be. However, some variation in this criterion may be necessary in view of other factors to be hereinafter discussed. For example, the effective size of the target, i.e. the area thereof which is available for audible response upon contact with a mallet, should preferably be equal to the size of the mallet head such that the opportunity to strike the target or miss same is substantially equal for both contestants. Thus adjustments may have to be made to accomplish this purpose.

Moreover, in accordance with this invention, the target, which is preferably in the form of a bell or gong, is mounted on a base provided with means to mount the gong, such as a post separating the gong from the base to permit the gong to emit a sharp, audible sound upon impact with a mallet.

The base should also be so constructed that upon impact of a mallet with the bottom or side portions of the base, there is no substantial audible sound emitted by the target or gong mounted thereabove, in contrast to the sound emitted by the direct impact of the mallet on the target which emits substantial resounding audible sound.

The targets, each mounted on a base as above described, are affixed to elongated handles of appropriate length, to be held in each hand of one contestant; and the mallets are similarly provided with elongated handles of appropriate length, advantageously of substantially the same length as are the handles affixed to the the targets. The respective lengths of the mallet handles in relation to the lengths of the target handles may also differ, if necessary, to adjust for differences in the relative weight and size of each mallet head and target, thereby equalizing the opportunity of each contestant to score or miss during play.

In playing the game the preferred mode is for one contestant initially to hold in each of his hands the respective handles of the targets, and the other contestant to hold in his hands the respective handles of the mallets. At the start of the game, the targets are preferably held immediately above the mallets. The object of the game is then for the contestant holding the mallets to strike either or both of the targets held by the other contestant with one mallet or the other to score.

This may be continued and the score recorded; or the positions of the players may be reversed on a clear miss by the contestant holding the mallets; or the positions may be reversed by a prearranged number of misses by the contestant holding the mallets, depending upon the rules established for the game.

DETAILED DESCRIPTION OF THE INVENTION

The invention will be more fully understood by the following more detailed description in relation to the accompanying drawings in which:

FIG. 1 is a schematic view showing a preferred mode of playing the game of this invention;

FIG. 2 is an elevation in section of a metallic gong employed as a target;

FIG. 3 is a top plan view of the gong of FIG. 2;

FIG. 4 is a schematic side elevation, in section, of a metallic target and base showing one means for affixing the target of FIGS. 2 and 3 to a base;

FIG. 5 is a view similar to FIG. 4 showing another means for affixing the target to the base;

FIG. 6 is a similar view showing yet another means for affixing the target to the base;

FIG. 7 is a similar view showing still another means for affixing the target to the base;

FIG. 8 is a similar view showing a further means for affixing the target to the base;

FIG. 9 is a side elevation, in section, showing a more specific form of metallic target and base construction which may be utilized according to this invention;

FIG. 10 is a side elevation in section of a preferred form of metallic target and base construction which may be utilized according to this invention;

FIG. 11 is a sectional view taken along line 11-11 of FIG. 10;

FIG. 12 is a bottom plan view of the structure of FIGS. 10 and 11;

FIG. 13 is a top plan view of still another form of target and base construction utilizing a metallic bar as the target; and FIG. 14 is a side elevation of the construction of FIG. 12.

Referring to FIG. 1, there is shown a schematic view representing a preferred mode of playing the game according to this invention. As shown therein, there are provided a pair of targets generally indicated at 2 and 2' to be held in the right and left hands of one contestant, and a pair of mallets generally indicated at 4 and 4' to be held in the left and right hands of another contestant, respectively. More specifically, the targets comprise bases 8 and 8' supporting metallic bodies 6 and 6', respectively, each of the bases 8 and 8' being affixed to handles 10 and 10' for purposes of manipulating the targets. On the other hand, the mallets are comprised of striking heads 12 and 12' to which are affixed handles 14 and 14', respectively, for the purpose of striking the metallic portions of the targets at 6 and /or 6' from the top or sides of such targets.

FIG. 2 shows a sectional elevation or a preferred form of gong which may be employed as a target 6; and FIG. 3 shows a top plan view thereof.

FIG. 4 is a schematic side elevation, in section, of a metallic target and base construction showing one means of affixing the target to the base. In this embodiment, the base 8 is substantially of the same diameter as that of the metallic gong mounted thereabove. As in FIG. 1, the base 8 is affixed to a handle 10 in a permanent and secure manner as by gluing, and the top of the base is provided with a post 16 preferably forming an integral part of the base for the purpose of supporting the gong 6. The gong 6 in this embodiment is affixed to the post 16 by means of a threaded screw or bolt passing through a central hole 15 of gong 6 and driven into a central bore 28 in post 16. Screw 18 may alternatively be a threaded nail similarly applied. Between the top of post 16 and the bottom side of metallic gong 6, there is disposed a resilient washer 20 of felt or equivalent material for the purpose of enhancing the accoustical vibrations of gong 6 or 6' upon being struck by one of the mallets 4 or 4' shown in FIG. 1.

The embodiment of FIG. 5 shows a view similar to that of FIG. 4 and provides a different means, namely rivet 22 passing through central bore 28 for affixing the gong 6 to the post 16. Rivet 22 may be metallic or plastic, provided that the gong 6 is firmly affixed to the post 16 so that upon impact with a mallet, it will not readily loosen.

The bottom portion of the base 8 in FIG. 5 is preferably recessed at 24 to assure that rivet 22 does not project therebeneath and thus provide a rigid member for transmitting an impact from the bottom of base 8 through the rivet and to the gong 6. In other words, it is an important aspect of this invention that a significant audible sound not be emitted upon impact of a mallet on the bottom of base 8, but rather, that a sharply distinct audible sound be emitted only upon impact of the mallet on the upper region of gong 6 or on its outer sides.

In the embodiment of FIG. 6, a similar view is shown wherein the gong 6 is affixed to the post 16 by means of a plastic pin 26 which is inserted into central bore 28 passing through post 16 and base 8 and therein glued by an suitable, strong, adhesive such as an epoxy resin adhesive.

FIG. 7 shows still another means for affixing the gong 6 to the post 16 wherein the post 16 is provided with an upper projection 30 passing through central hole 15 in gong 6 and thereafter heat-sealed by applying heat to the upper portion of the projection 30 to form an integral flange portion 32 retaining gong 6 on post 16.

It is also contemplated that the gong 6 may be affixed to base 8 by employing a relatively soft resilient material for the base 8 and post 16 and providing the post at the top thereof with a pre-moulded nub 34 providing a flange which is capable of being forced through hole 15 of gong 6 and thereafter spreading above the top of the gong 6 to retain the same on the top of the post 16 as shown in FIG. 8. In this embodiment the base assembly is preferably composed or a vinyl or similar material to confer the necessary degree or resiliciency for the purposes described.

In the embodiments shown in FIGS. 5 to 8, the outer diameter or periphery of base 8 is greater than that of gong 6 for the purpose of making it more difficut for the contestant holding the mallets to strike the upper portion of the gong 6, as will be more fully described hereinafter.

The figures described above are schematic to illustrate basic concepts of construction which may be employed in accordance with the present invention. A more specific embodiment, however, is illustrated in FIG. 9 wherein the gong or target 6 is mounted on a base 36 which has substantially a shell-like configuration supporting a central post 16, as in the other embodiments described. In this case, the gong 6 may be affixed to post 16 by means of a threaded screw, bolt or nail 18 as in the embodiment of FIG. 4; but the other means described for attaching the gong to the base post 16 may also be employed. The inner portion of the base 36 may be provided with a plurality of radial ribs (not shown in FIG. 9) between the inner periphery of base 36 and post 16 to reinforce the base and post, as for example, in the embodiment or FIG. 10 to be hereinafter described. Handle 10, while not shown in FIG. 9, is affixed to base 36 by appropriate means, such as also shown in FIG. 10 to be hereinafter described. If desired, the bottom of base 36 may be provided with an indentation or recess 38 to receive a mallet head 12 or 12' during the course of playing the game.

The embodiment of FIGS. 10, 11 and 12 shows a preferred form of target assembly to be used according to this invention, wherein the base 8 comprises a plastic wheel-like member having an outer rim 40 and an upwardly projecting central post 16 onto which is affixed the gong 6. The central post 16 is connected to the rim 40 by means of a plurality of ribs or spokes 42,44,46 and 48 of sufficient depth and dimension to fully support the post and gong 6 and to withstand impact when the mallet strikes the top or sides of gong 6. As shown in FIG. 11, rib 48 is sufficiently enlarged to accomodate a bore for receiving handle 10, rib 48 being of such thickness with respect to the diameter of handle 10, that it will withstand the impact caused by the mallets striking the gong 6. The spaces between ribs 42, 44, 46 and 48 may be completely open from the top to the bottom of the base 8 if the dimensions of the base 8 and the materials of which is constructed are such that there is provided sufficient strength to withstand the impact during playing of the game. On the other hand, it is also contemplated that the bottom or top of the base shown in FIGS. 10, 11 and 12 may be completely enclosed by structural material extending thereacross to provide additional strength as may be required.

As shown in FIG. 10, the other rim 40 of the wheel-like base 8 projects beneath the ribs 42, 44, 46 and 48 in the form of a depending skirt 49 to form a recess 50 beneath the base and within the perimeter of rim 40. This recess 50 may vary in depth and configuration to receive and initially accommodate at least part of a mallet head 12 at the start of each play of the game to make it more difficult for the mallet holder to strike the metallic gong 6. When spherical mallet heads are employed, the recess may be of a concave, hemispherical configuration formed by the bottom portions of the aforesaid ribs 42,44,46 and 48 or by a continuous bottom portion of the base 8. The depth of depending skirt 49 forming recess 50 (when spherical mallet heads are employed) is advantageously up to one third the surface area of the mallet head, and even greater, but limited by the position of the mallet handle 14, beyond which the mallet head 12 is not readily recessed. It is fundamental that sufficient tolerance exist between the outer surface of the mallet head 12 and recess 50 so that the mallet heads are only loosely retained by the base 8 at the start of play and may easily disengage therefrom during play. From the foregoing description, it should be apparent that if a mallet head 12 is inserted in recess 50 at the start of play it becomes easier to regulate the game, but more difficult to strike the gong 6 with the mallet head.

A still further embodiment of the invention is shown in FIGS. 13 and 14 which provide for the base 8 to support a metallic bar 52, the bar being of rectangular shape and suspended above a corresponding rectangular base 8 by means of pins (screws or threaded nails 54 or 54'), respectively, which are received in slots 56 and 56' cut in bar 52. In this respect, the dimensions of the slots and of the shank portions of the screws or nails 54 and 54' are such that sufficient tolerance is provided to permit the bar to float freely about the pins and thereby minimize any dampening effect produced by the pins. To further the acoustical properties of bar 52, the bar is mounted on resilient pads such as felt pads 58 and 58' as shown in FIG.14, thereby facilitating proper vibration or the bar 52 upon impact with the heads of mallets 4 or 4'.

In all of the foregoing embodiments, the handles 10 and 10' should be firmly affixed to bases 8 or 8' respectively by suitable means such as gluing with a strong resin, i.e. epoxy resin or by any other means known in the art and the mallet heads 12 and 12' should be so affixed to handles 14 and 14', to withstand the impact which will result during playing of the game, without losening of the handles from the respective components. The ends of handles 10, 10', 14 and 14' may be slotted where they enter the bases or mallet heads to facilitate introduction thereinto during assembly.

It should be clear from the foregoing that there are a number of factors which enter into the construction of the targets and mallets of this invention and more specifically the parameters relating to the size, weight, construction and balance of the various elements utilized, which may vary, but nevertheless, can be important in terms of the ultimate result desired.

The metallic targets 6 and 52 which have been referred to are preferably constructed of acoustical steel of a type well-known in the art, for example, that used in the construction of bells or gongs for bicycle bells and other purposes. Various other alloys may be employed, such as brass, bronze aluminum and others provided that they emit a sharp, audible sound on impact with a mallet or similar implement. If gongs are not employed, the targets may be constructed by metallic bars of the type used for percussion instruments. In any case, it is important that the metallic bodies used as targets should be such that they emit a sharp, audible sound upon being struck by a mallet or similar implement as indicated.

It is also important that the metallic body be sufficiently spaced from the base, say about ⅛' in the case of gongs to avoid any dampening by virtue of the gong touching the base upon repeated impact with the mallets. The metallic bodies should also be of such size that they are capable of being struck with a mallet without inordinate difficulty, and accordingly, there are general limitations on the size of the metallic body to be employed in this invention. For example, if a gong is too small, it does not ring properly upon being struck by a mallet and will not be suitable, nor will it be possible to hit it with sufficient frequency to achieve the purposes of the invention. On the other hand, if the gong is too large, it will be too easy to strike, too heavy and require an excessively large mallet to achieve the purposes of this invention, namely if a ture contest between the participants is to be achieved. There is therefore a desirable balance between the size and weight of the components employed.

In addition, there are many methods which may be employed to affix the metallic target to the base thereof. As is illustrated in various of the figures of the drawings submitted herewith, this may be accomplished for example, by means of screws, threaded nails, metallic rivets, and plastic rivets or pins which may be glued if necessary to affix the metallic target to the base, as illustratively described hereinabove.

In this connection, it is important that the means utilized for affixing the target to the base, especially if it is a rigid metallic means, does not project below the bottom of the base so that the mallets held by one of the contestants may be capable of an impact on said means which would be transmitted to the metallic target thereabove and thereby emit a substantial audible sound. In other words, the impact of a mallet on the bottom or side of the base preferably should not emit a substantially audible sound, in contrast to the sharp auidible sound derived from direct impact of the mallet upon the upper or side portions of the metallic target. For this reason any rigid means employed for affixing the target to the base should preferably be recessed above the bottom of the base so that it will not be in direct contact with the mallets if the base is struck from below.

The size of the base in relation to the metallic target is also an important factor. For example, if the exposed area of the metallic target is precisely the same as that of the base, the opportunity for the contestant holding the mallets to hit the metallic targets may be disproportunate in relation to the opportunity of the contestant holding the targets to cause a miss. However, if the base supporting the metallic target is somewhat larger in diameter or in other dimensions in relation to the dimensions of the metallic target (when viewed from the top thereof) it becomes more difficult for the contestant holding the mallets to hit a metallic target from a side thereof and therefore it becomes more necessary for the mallet holder to attempt to strike the upper portion of the metallic target. Thus, it is possible, by increasing the top area of the base in relation to that of the metallic target to equalize the opportunities to score or miss, which might not otherwise be possible depending upon the weight and dimensions of the target and striking implement, such as a mallet head.

When the top area of the base supporting the target is designed to be greater than that of the metallic target, it is preferred to employ for example, in the case of a gong, a base extending beyond the radius of the gong by from about ¼ to ½ the dimension of said radius; and in the case of any other metallic target, such as a bar, a base extending from about ¼ to ½ beyond the dimensions of lines drawn from the center of the bar to the outer periphery thereof in each direction.

As previously pointed out, it is an ideal situation to provide targets and striking implements wherein the weight of each is equally balanced to equalize to a maximum degree the respective opportunities of the contestants to score or miss. Thus it is especially preferred that the weights are equal. As a practical matter however, this may not be feasible. Due to the availability of various materials of construction and variations in the construction of the mallets and targets, the weight of the target, particularly since a metallic body is employed, may exceed that of the mallets. Where there is a differential between the weights of the targets and mallets, to some extent this may be compensated for by providing more weight in the mallets. However, there reaches a point when the size and weight of the mallet can become a hazzard. When the weight of the target exceeds that of the mallet, this can be compensated for by increasing the size of the base in relation to that of the metallic target.

Generally, it has been found that the combined weight of each base and metallic body may be substantially from about equal to about one and two-thirds that of each mallet head and yet achieve the purposes of this invention. However, the size of the various components may require suitable adjustment to compensate for such weight variations, or visa versa.

The size of the metallic targets in relation to the size of the mallets is also an important factor since this further has a bearing on the relative opportunity of each contestant to hit or be forced to miss the target. If the target is in the form of a gong, the entire area of the gong is not normally available for scoring purposes, since the central portion of a gong, if struck directly on the pin, or other means holding the gong to the base, will not normally produce a sharp, audible ring, in contrast to the sound emitted if the gong were hit off center or on the side thereof. Thus, it is possible to utilize a mallet of somewhat smaller diameter than the diameter of the gong and still achieve the purposes of this invention. Generally speaking, where substantially spherical mallet heads are employed, the diameter of the gong may be from about equal to 1 ½ times the diameter of the mallet heads. A 1 and ¼ inch, substantially spherical mallet has been found to be effective when used with about a 1 and ⅜ inch gong. Of course, as the dimensions and weight of either or the gongs or mallets vary, the dimensions and weight of the others should be suitably adjusted for best results.

The materials of construction may also vary considerably, the material for the base of the target being preferably of plastic material such as polyethylene, polypropylene and vinyl plastic materials which are capable of withstanding a substantial impact, but which also have some degree of resiliency. The harder plastic materials such as phenolics, polystyrene and cellulose acetate may also be employed if desired provided that they are not so hard or rigid that they defeat the purposes of the invention in the particular form employed. Wooden bases may also be used but are not preferred because of their hardness, weight and lack of resiliency.

The mallet heads employed may have different configurations but are preferably spherical, although they may be between spherical and cylindrical for the purposes of this invention. The materials employed for the mallet heads are preferably of wood because a larger size may be employed to approach the size of the metallic targets and at the same time achieve a more desirable balance of weight between each target and mallet. While plastic materials may also be employed for the mallet heads the characteristics of the particular materials selected should be such that the weights, size and balance thereof meet those of this invention. If plastic is selected it should have relatively high impact strength.

The length of the handles supporting the tragets and the mallets is also an important factor since if the handles are too long, there is little opportunity for the person holding the mallets to strike the targets; and if they are too short, it creates an opportunity for the person holding the mallets to strike the hands of the contestant holding the targets. In some cases the handles of the mallets and targets may be of different lengths to equalize the opportunities of the game, or they may be provided with indicia (e.g. different colors or bands) to designate different positions for the hands of the contestants when the handles are of equal length. Accordingly, it has been found that the handles should range from about 6 to 10 inches in length measured from the outside of the base of the target and the outside of the head of the mallet, and preferably about 7 to 9 inches to accomplish the purposes of this invention. The handles are preferably cylindrical and of ¼ inch diameter hardwood such as birch, maple, ash or the like to provide a degree of rigidity, although plastics may be employed that they are not unduly flexible to the point where the mallets and targets cannot be properly controlled.

It should be clear from the foregoing that the various parameters discussed with respect to weight, size, shape etc. of the mallets and targets dictate that whatever of these are selected, each of the two targets and each of the two mallets should be substantially the same in all respects.

The rules or the game may be varied depending upon the contestants, one possibility being simply to provide that when a contestant holding the mallets scores by hitting the metallic target, he continues to play until he misses. A miss may be indicated when a contestant raises his mallet from a horizontal position and from beneath the base of the target to above the target, and upon attempting to strike the target, fails to hit it. At this point each contestant may exchange the mallets and targets and the other contestant be given an opportunity to hit the targets.

Another variation in scoring is to give the contestant holding the mallets an opportunity to score or miss up to say 5 times, as in table tennis, and then switch the mallets to the other contestant. Thus, the contestant holding the mallets may score three times by hitting the targets and may miss twice before the mallets are exchanged for the next round. Thereafter the game may be continued until a pre-arranged score is arrived at, such as 15 or 21, or whatever the case may be.

In a further variation each contestant may hold one mallet and one target in each hand, respectively and attempt to score by striking the target held by the other. In a still further variation the contestant holding the targets may hold them upside down from the position shown in FIG. 1 with the contestant holding the mallets initially holding the same above the targets, making it more difficult to score from beneath the inverted targets.

It should thus be clear that during the course of play the targets may be manipulated into a variety of positions, but for purposes of illustrating the invention reference has been made herein to "a normal upright position" and the structure of the targets has been described in that context. Accordingly, where the relative positions of the various components of the targets, etc. are referred to in the specification and claims, these relate to the structure in the positions as shown and described and not to any positions that they may assume during play of the game. For example, it should be clear that after play is initiated the metallic targets may be struck in any position in which the target holder manipulates them, i.e. upright, sidewise or inverted, provided that such manipulation complies with the rules of the game.

Having thus described the invention, it should be clear that resort may be had to various modifications and equivalents as fall within the spirit of the invention and the scope of the claims hereinafter made.

I claim:

1. A manual dexterity percussion game apparatus comprising a pair of targets, each adapted to be manipulated by the hands of one contestant and to be struck by one or both of a pair of striking implements each manipulated by the hands of another contestant, said targets each comprising a base to which is affixed a handle for manipulating the target, a metallic body mounted above said base and adapted to emit an audible sound upon impact with a striking implement held by the other contestant upon contact with same, the outer dimensions of said base when viewed from above being at least equal to those of said metallic body mounted thereabove, such that said metallic body will emit a substantial audible sound upon contact with a striking implement from above the base when the target is in a normal upright position with respect to the base thereof, and in any other position to which the target is manipulated by the holder thereof.

2. An apparatus according to claim 1 wherein the outer dimensions of each base when viewed from above exceed the outer dimensions of each metallic body.

3. An apparatus according to claim 2 wherein said base extends beyond the outer periphery of said metallic body by from about ¼ to ½ the dimension of a line drawn from the center to the outer periphery of said metallic body.

4. An apparatus according to claim 1 wherein the metallic body is in the form of a gong, and the striking implement is a mallet having a handle and a head.

5. An apparatus according to claim 4, wherein the diameter of the gong is from about equal to about one and one half times the diameter of the mallet head.

6. An apparatus according to claim 1 wherein the metallic body is in the form of a bar.

7. An apparatus according to claim 1 wherein said base is provided with an upright pedestal and means for affixing the metallic body thereto in spaced relationship from the base.

8. An apparatus according to claim 7 wherein the means for affixing the metallic body is a rivet.

9. An apparatus according to claim 7 wherein the means for affixing the metallic body is a threaded member.

10. An apparatus according to claim 7 wherein the means for affixing the metallic body is a nail provided with grooves on its shank.

11. An apparatus according to claim 7 wherein the means for affixing the metallic body is a resilient plastic nub formed at the end of the pedestal retaining said metallic body in an annular slot formed thereby and adapted to receive said body.

12. An apparatus according to claim 7, wherein the means for affixing the metallic body is a plastic pin glued within said pedestal.

13. An apparatus according to claim 1 wherein said base is formed of a resilient plastic material provided with a plurality of radially spaced ribs supporting an upright pedestal within said base.

14. An apparatus according to claim 1 wherein said base includes an outer depending skirt forming a recess adapted to receive and freely envelope at the start of play, a portion of a head provided on the striking implement.

15. An apparatus according to claim 1, which is adapted to be struck by a striking implement comprising a mallet provided with a handle and a mallet head.

16. An apparatus according to claim 15, wherein the relative combined weight of each base and metallic body is substantially from about equal to about one and two thirds that of a mallet head of each striking implement.

17. An apparatus according to claim 15 wherein the handles of the targets and mallets are constructed of wood.

18. An apparatus according to claim 15 wherein the lengths of the handles of the mallets and targets are from about 6 to 10 inches.

19. An apparatus according to claim 15 wherein the lengths of the handles of the mallets and targets are about 7 to 9 inches.

20. A manual dexterity percussion game apparatus comprising a pair of targets, each adapted to be manipulated by the hands of one contestant and to be struck by the heads of one or both of a pair of mallets having substantially rigid handles, said targets each comprising a base to which is affixed a substantially rigid handle for manipulating the target, a metallic gong mounted above said base on a central pedestal extending from said base sufficiently thereabove to position the gong in spaced relationship from the base, the outer dimensions of the base, when viewed from above, exceeding those of said gong, said base further comprising a wheel-like outer supporting structure and a plurality of spaced ribs connecting said pedestal to said outer structure and reinforcing the same, one of said ribs being enlarged to form a segment provided with a bore for receiving the handle of the target, the lower portion of said base being provided with an outer depending skirt forming a recess adapted to receive and freely envelope a portion of a mallet head at the start of the play of the game.

21. An apparatus according to claim 20 wherein the base structure is an integral molding of substantially resilient plastic material of relatively high impact strength, sufficient to withstand repeated blows by a mallet head and without transmitting sufficient vibrations to the gong to cause the same to emit a significant audible sound when the base is struck by a mallet head from below or the sides thereof, in contrast to the sound emitted by the direct impact of a mallet head on the gong.

22. A target for use in a manual dexterity percussion game apparatus adapted to be manipulated by one contestant and to be struck by a striking implement manipulated by another contestant, said target comprising a base to which is affixed a handle for manipulating the target, a metallic body mounted above said base and adapted to emit an audible sound upon impact with a striking implement held by the other contestant upon contact with same, the outer dimensions of said base when viewed from above being at least equal to those of said metallic body mounted thereabove, such that said metallic body will emit a substantial audible sound upon contact with a striking implement from above the base when the target is in a normal upright position with respect to the base thereof.

23. A target for use in a manual dexterity percussion game apparatus adapted to be manipulated by one contestant and to be struck by the head of a mallet manipulated by another contestant, said target comprising a base to which is affixed a handle for manipulating the target, a metallic gong mounted above said base on a central pedestal extending from said base sufficiently thereabove to position the gong in spaced relationship from the base, the outer dimensions of the base, when viewed from above, exceeding those of said gong, said base further comprising a wheel-like outer supporting structure and a plurality of radially spaced ribs connecting said pedestal to said outer structure and reinforcing the same, one of said ribs being enlarged to form a segment provided with a bore for receiving the handle of the target, the lower portion of said base being provided with a recess adapted to receive and freely envelope a portion of said mallet head at the start of play of the game.

24. An apparatus for testing skill and dexterity between contestants comprising in combination, a target adapted to be presented and manipulated by a first contestant toward a second contestant, a striking implement adapted to be presented and manipulated by said second contestant in spaced proximity to said target, said target further comprising a base to which is affixed means for holding and manipulating same, and a metallic body mounted above said base adapted to emit an audible sound upon impact with said striking implement held by said second contestant, whereby the skill and dexterity of said first contestant in avoiding contact and of said second contestant in making contact between said target and striking implement may be measured by the indications of contact or lack of contact therebetween.

* * * * *